US011040272B2

(12) United States Patent
Packett

(10) Patent No.: US 11,040,272 B2
(45) Date of Patent: Jun. 22, 2021

(54) SYSTEM AND METHOD FOR BINGO CARD NESTING IN GAME FEATURE RESOLUTION

(71) Applicant: Class II Solutions, LLC, Dallas, TX (US)

(72) Inventor: James W. Packett, Plano, TX (US)

(73) Assignee: Class II Solutions, LLC, Dallas, TX (US)

( * ) Notice: Subject to any disclaimer, the term of this patent is extended or adjusted under 35 U.S.C. 154(b) by 0 days.

(21) Appl. No.: 16/528,189

(22) Filed: Jul. 31, 2019

(65) Prior Publication Data

US 2020/0038741 A1 Feb. 6, 2020

Related U.S. Application Data

(60) Provisional application No. 62/712,483, filed on Jul. 31, 2018.

(51) Int. Cl.

| | |
|---|---|
| ***A63F 3/06*** | (2006.01) |
| ***G07F 17/12*** | (2006.01) |
| ***G07F 17/32*** | (2006.01) |

(52) U.S. Cl.

CPC ..... *A63F 3/0645* (2013.01); *G07F 17/3204* (2013.01); *G07F 17/3225* (2013.01); *G07F 17/3244* (2013.01); *G07F 17/3286* (2013.01); *G07F 17/3272* (2013.01)

(58) Field of Classification Search

None

See application file for complete search history.

(56) References Cited

U.S. PATENT DOCUMENTS

| | | | | |
|---|---|---|---|---|
| 2005/0059468 | A1* | 3/2005 | Cannon | G07F 17/3225 463/19 |
| 2013/0130766 | A1* | 5/2013 | Harris | G07F 17/323 463/19 |
| 2014/0179393 | A1* | 6/2014 | Cuddy | G07F 17/3225 463/19 |

* cited by examiner

*Primary Examiner* — Damon J Pierce

(74) *Attorney, Agent, or Firm* — DuBois, Bryant & Campbell, LLP; William D. Wiese

(57) ABSTRACT

A gaming method and system are disclosed wherein the number of available bingo patterns that may be used in a class II game are significantly increased. When using a class II gaming engine to determine the results of a class II game play, a bingo card associated with a feature may award credit values and also one or more additional nested bingo cards, to all be played within the resolution of a single feature. This feature nesting increases the number of patterns available, thereby increasing the distribution of prizes in a class II game. By expanding the number of available patterns in this manner, it is possible to improve a player's experience when playing a class II game, and to better replicate the target prize distribution for all features of a class III game on a class II game.

23 Claims, 4 Drawing Sheets

SYSTEM AND METHOD FOR BINGO CARD NESTING IN GAME FEATURE RESOLUTION

PRIORITY STATEMENT

Under 35 U.S.C. § 119 & 37 C.F.R. § 1.78

This non-provisional application claims priority based upon prior U.S. Provisional Patent Application Ser. No. 62/712,483 filed Jul. 31, 2018 in the names of James W. Packett entitled "FEATURE NESTING," the disclosure of which is incorporated herein in its entirety by reference as if fully set forth herein.

BACKGROUND OF THE INVENTION

The types of games that may be operated on tribal lands in the United States are regulated under the Indian Gaming Regulatory Act (IGRA). The IGRA divides games into three classes. Class I games are traditional Indian gaming, which may be part of tribal ceremonies and celebrations, and social gaming for minimal prizes.

Class II games are defined as a game of chance commonly known as bingo and, if played in the same location as a bingo game, pull tabs, punch board and other games similar to bingo. Class II gaming also includes non-banked card games, that is, games that are played exclusively against other players rather than against the house or a player acting as a bank.

Class III gaming is anything that doesn't fall under class I or class II. Simply put, class III gaming is traditional "Las Vegas" or "casino-style" gambling. Table games like roulette, blackjack and craps are all considered class III gaming, as would the random number generator-based slot machines and video poker games. Game terminals for class III games generally include software and/or hardware for generating random numbers to determine the class III game results.

As a general matter, class II gaming is self-regulated by a tribe and the National Indian Gaming Commission (NIGC) provides regulatory oversight and support according to the provision of the IGRA. The state where a tribal casino is located has no jurisdiction over class II gaming. In contrast, a state does have authority to regulate class III gaming pursuant to a contract negotiated with the tribe, known as a Tribal-State Compact. Importantly, the IGRA permits class II games to utilize "electronic, computer or other technologic aids."

There are several reasons why tribes in certain states have considerable incentive to operate more successful class II gaming in their casinos. The most significant factor in many cases is that the revenue generated by class II gaming is not typically included in the revenue sharing agreement between the tribe and the state, while class III gaming revenue is included in that agreement pursuant to the applicable class III Tribal-State Compact. As the IGRA was enacted to promote and support tribal economic development, self-sufficiency, and strong tribal governments through the operation of gaming on Indian lands, more successful class II gaming in their casinos are needed to further that effort.

However, the creation of a robust class II gaming engine and the bingo math involved in creating regulatory-compliant class II games is an intellectually difficult and time consuming project that hinders some casino game manufacturers from entering the class II market, delays others by years because of the development time involved, and causes others to actually supply less successful class II games or ultimately fail and cease such product offerings in the market.

As background, in modern casino game development, a game is composed of distinct features (i.e., game states and their respective prizes). Such game states include the specific base game state—such as, for example, a "lines" mechanic on virtual-reels or a "ways-to-win" mechanic on probability-reels—typically along with one or more demarcated bonus game states—such as, for example, a "pick 'em mechanic," a "prize wheel," or a set number of "free-spins" with a chance to "re-spin."

The conventional class II game approach to replicating a feature design incorporates gameplay by a class II gaming engine of a bingo card associated with the feature, that is eligible to win a game ending pattern, along with a sequence of secondary patterns through a common ball draw in a bingo game. Together, these comprise the pattern sets and prizes for the class II game that are used by the class II gaming engine to determine the bingo game results and resolve the associated feature on the game terminal. With careful pattern selection, the corresponding win probabilities, or prize distributions, for a class II game may be fine-tuned to produce feature-gameplay that roughly approximates the statistical characteristics of a target feature prize distribution.

The statistical design targets may be original, or they may be motivated by, for example, class III-to-class II game conversions. In any case, closely approximating a feature prize distribution target is considered crucial to creation of a successful class II game. However, conventional class II games are often poor approximations, and the resulting gameplay may deviate markedly from the desired target feature distribution. Moreover, this design obstacle causes time delays and has grown worse over time as the casino industry moves to more elaborate game features, while simultaneously tightening the specificity of target prize distributions The root of the statistical limitations of class II games stem from the scarcity of useable bingo patterns to resolve a target feature. Although the universe of possible patterns may be quite large, only a relatively small subset of those may be utilized by a class II gaming engine to determine the results within a single card evaluation. Fundamentally, every sequence of pattern sets produces a unique sequence of prize-probabilities. As the number of patterns used in a pattern set increases, a saturation effect begins to dominate. The effect imposes a ceiling on the number of prizes, as well as a floor on the numerical resolution of probabilities, for a bingo game. As a result, not every sequence of prize-probabilities may be produced via a corresponding pattern set. For example, in FIG. 1, the possibilities are limited to 16 patterns and therefore the class II game would be required to approximate the entire prize distribution of a target feature utilizing only those 16 patterns.

This limitation manifests itself in many ways. For example, in some instances it may be desirable to create a class II game that replicates the features of an existing class III game. In that case, the target prize distribution of the class II game is the statistical feature-gameplay of the associated class III game. As will be appreciated by those skilled in the art, class III games have recently experienced a sharp increase in feature complexity and control, and the gap between class II games and class III games has grown significantly. As a result, the limitations of class II games described have created the impression in the past among those in the casino industry that class II games inherently produce an inferior gameplay experience in comparison to their class III counterparts.

Even in the case where a casino game manufacturer is creating a new class II game, the manufacturer has traditionally faced similar impediments imposed by the limitation in possible bingo patterns and speed to market for accurate pattern selections, and the casino industry could benefit from analogous feature expansion in the class II game marketplace.

There is a need, therefore, for a service that allows casino game manufacturers to enter the class II gaming market in a short period of time, connecting new or already developed game terminals to a class II gaming engine that enables them to easily and readily deploy new, or convert existing, games to class II games by utilizing a robust class II gaming engine; along with a method of generating additional bingo patterns for use by the class II gaming engine to determine the bingo-generated game results in a class II game for a targeted prize distribution within a single feature, thereby eliminating the statistical limitations inherent in conventional class II games and in turn producing a player experience in the created class II game that is nearly identical, or virtually indistinguishable, to that of the original, targeted game design.

SUMMARY OF THE INVENTION

Disclosed are systems and methods for improving the play of a class II game and, more specifically, increasing the number of available patterns that may be used by the class II gaming engine to determine the bingo-generated game results for a targeted prize distribution within a single feature. In fact, embodiments of the present invention provide a vastly increased array of available patterns by allowing the bingo card played using the class II gaming engine, in a defined class II game state associated with a feature, the ability to award not only credit values, but also additional bingo cards to be played by the class II gaming engine, in a defined class II game state associated with the same target feature, referred to herein as "nested" bingo cards. Therefore, each class II game play result may possibly open play for a new, or previously obtained, nested bingo card to be played in a defined class II game state, whereby the target feature is either resolved or is further nested in the class II game play of yet another card, without limit until the feature is resolved, referred to herein as "feature nesting". By expanding the number of available patterns with feature nesting, it is possible to improve a player's experience when playing a class II game, and to better replicate the features of a class III game on a class II game.

In various implementations, class III games in a casino are communicatively coupled through a local area network to a class II gaming engine. The class II gaming engine uses distributions of pattern set solutions of a bingo game that, in some embodiments, replicate the distributions of states and prizes from a class III game design to replicate the player's experience on the class II game. Games that are modified for class II in this manner may be designed from newly-created class III games, existing class III games, or class III games that would be better suited for class II play.

To properly replicate a player's experience on a class II game, a class III game is partitioned into each of its separate states and statistics are collected throughout the game's play cycle, including the prizes (i.e., the universe of credit wins and state transitions). This information is paired against matching distributions of pattern set solutions to a bingo game, and those solutions are used to create bingo prize tables having the target credit wins and transitions for the class II game states, and their representative pattern sets. Feature nesting is utilized, as the target game design dictates, to increase the number of available patterns used by the class II gaming engine to determine the bingo-generated game results for a targeted prize distribution within a single feature.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

DESCRIPTION OF THE DRAWINGS

For a more complete understanding of the present invention, and the advantages thereof, reference is now made to the following description taken in conjunction with the accompanying drawing, in which.

DESCRIPTION OF THE PREFERRED EMBODIMENTS

Figure 1:
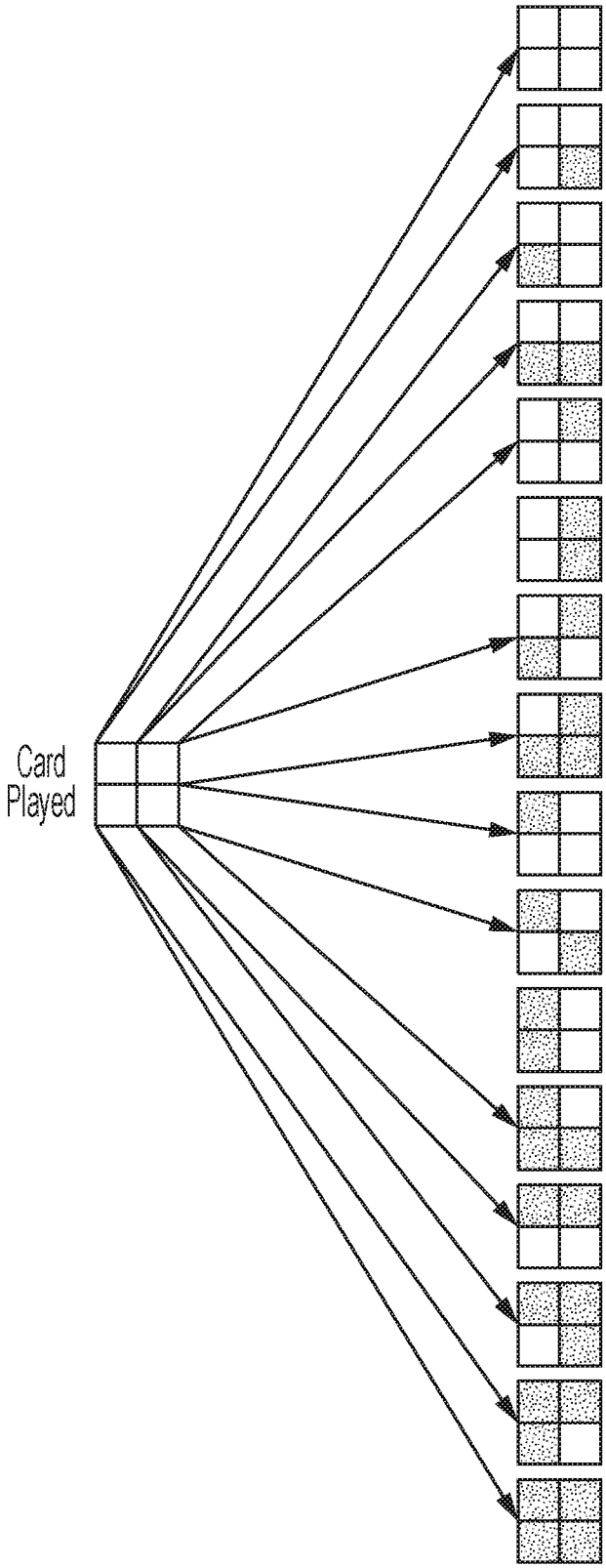
FIG. 1 is a schematic view of a simplified example using a 2×2 card to show that without feature nesting the limit is 16 patterns which the class II gaming engine can determine are the bingo-generated game results within a single feature.

The present invention is directed to improved methods and systems for, among other things, feature nesting in class II gaming. The configuration and use of the presently preferred embodiments are discussed in detail below. It should be appreciated, however, that the present invention provides many applicable inventive concepts that may be embodied in a wide variety of contexts other than those specifically described herein. Accordingly, the specific embodiments discussed are merely illustrative of specific ways to make and use the invention, and do not limit the scope of the invention. In addition, the following terms shall have the associated meaning when used herein:

"bingo game" means the combination of all cards played by players actively participating in a common ball draw in order to determine secondary pattern prizes and ending pattern prizes, as applicable per the rules and determined per the class II gaming engine;

"card" means the bingo card assigned to a player by the class II gaming engine for participation in a bingo game, in accordance with the rules;

"casino" means an Indian casino located in the U.S. authorized pursuant to applicable tribal, state and/or federal regulations, or any other class II market, or any other regulated casino market;

"class II gaming" or "class II games" means (i) the game of chance commonly known as bingo (whether or not electronic, computer, or other technologic aids are used in connection therewith) (I) which is played for prizes, including monetary prizes, with cards bearing numbers or other designations, (II) in which the holder of the card covers such numbers or designations when objects, similarly numbered or designated, are drawn or electronically determined, and (III) in which the game is won by the first person covering a previously designated arrangement of numbers or designations on such cards, including (if played in the same location) pull-tabs, lotto, punch boards, tip jars, instant bingo, and other games similar to bingo, and (ii) card games that (I) are explicitly authorized by the laws of the applicable state, or (II) are not explicitly prohibited by the laws of such state and are played at any location in such state, but only if such card games are played in conformity with those laws and regulations (if any) of such state regarding hours or periods of operation of such card games or limitations on wagers or pot sizes in such card games; the term "class II gaming" does not include (A) any banking card games, including baccarat, chemin de fer, or blackjack (21), or (B) electronic or electromechanical facsimiles of any game of chance or slot machines of any kind, and the terms used herein have the meanings set forth in 25 U.S.C. § 2703. Moreover, electronic or electromechanical facsimiles do not include the game of bingo "when the electronic or electromechanical format broadens participation by allowing multiple players to play with or against each other rather than with or against a machine" as defined in 25 C.F.R. § 502.8;

"class II gaming system" means all components, whether or not technologic aids in electronic, computer, mechanical, or other technologic form, that function together to aid the play of one or more class II games, including but not limited to a class II gaming engine and a game terminal;

"ending pattern" means the predefined bingo pattern, per the rules, that once achieved by a player results in (i) the award of a predefined prize, and (ii) the end of a bingo game;

"feature" means a distinct state, and its respective prizes, of a game;

"game terminal" means any device, or electronic or electromechanical gaming machine, or platform, or player interface, or system used by a casino to provide games to players;

"game" means any casino game, including but not limited to its features, rules, and the graphical representations, or technologic aids, derived from the game results and shown or otherwise presented to the player on the game terminal. For a class II game, the specific game selected for play by the player determines the rules applied by the class II gaming engine for each player participation in every bingo game;

"non-transitory" means a limitation of the medium itself (i.e., tangible, not a signal) as opposed to a limitation on data storage persistency (e.g., RAM vs. ROM);

"pattern set" means the secondary patterns and ending patterns that define a class II game;

"player" means the patrons of a casino utilizing a game terminal to participate in a game;

"prizes" means the universe of credit wins and state transitions for each state played within a game;

"rules" means the complete description of the game's play cycle, and other defined rules for the player specific to a game. For a class II game, rules include the defined pattern sets, corresponding prizes, and other defined rules for the player specific to a game;

"secondary pattern" means the predefined bingo patterns, per the rule, that once achieved by a player result in the award of a predefined prize, but NOT the end of a bingo game; and "state" means the various ways that a game may be played according to the rules, and its features (i.e. base game, bonus game, free spins, etc.). For a class II game, each state includes player participation in a bingo game, each state has a defined pattern set, and each state is associated with a defined feature when played in connection with a class II gaming engine.

Embodiments of the present invention provide a vastly increased array of available patterns, by allowing the bingo card played the ability to award not only credit values, but also nested bingo cards to be played by the class II gaming engine. In other words, each bingo result may possibly open play for a new, or previously obtained, nested bingo card to be played in a defined class II game state, whereby the target feature's prize is either resolved or is further nested in the class II game play of yet another card, without limit, until the feature is resolved. This has previously been defined as "feature nesting".

While not immediately obvious, those skilled in the art will conclude and appreciate that this feature nesting allows for quick growth in the set of useable winning patterns for a class II game.

For example, assume, for a given bingo card-size, the pattern saturation limit is N. Since each pattern may win another nested bingo card that also has a pattern saturation limit of N, we have a total of:

$$N \times N = N^2$$

useable patterns with a single nesting.

More generally speaking, if we nested C cards, we have a possible pattern $$\text{total of } \underbrace{N \times N \times \ldots \times N \times N}_{C} = N^C.$$

By nesting patterns in this manner, any feature probability space may be readily divided into partitioned subspaces, thereby resolving the core problem of pattern scarcity.

For example, if we have nested five cards having a pattern saturation limit of four, the number of possible patterns would be $4^5$, or 1,024.

Figure 2:
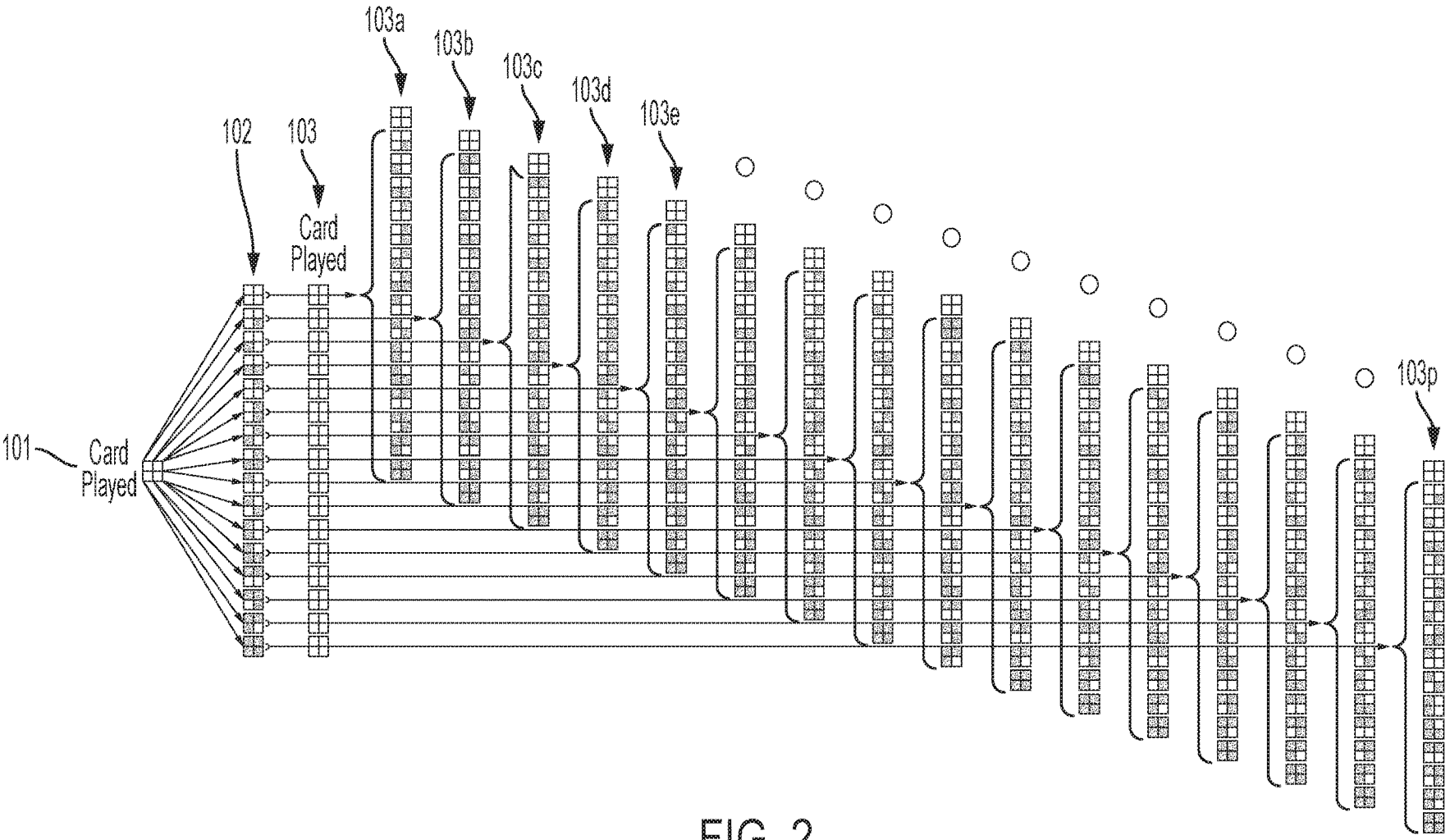
FIG. 2 is a schematic view of one embodiment of the feature nesting of the present invention.

Referring now to FIG. 2, which shows a schematic view of one embodiment of the nesting feature of the present invention. To start the process, a card is played 101 resulting in the generation of a pattern 102. The pattern may be any one of 16 different patterns. In each case, the pattern achieved 102 may result in a credit value won and/or an additional bingo card evaluation 103. The additional bingo card 103 may, once again, result in the generation of a pattern 103 and that pattern may be any one of 16 different patterns 103*a*, 103*b*, 103*c*, etc.

Embodiments of the present invention may include a game terminal in which technologic aids provide that bingo game results correspond to the resolution of features in a class III game such as, for example, a slot game, a roulette game, a keno game or a poker game. Through analysis, it may be determined that the class III game has a number of options for determining the distribution of prizes. The options may be, for example, a number of pay lines for a simulated slot game, a number of hands for a simulated poker game, a number of spots picked for a simulated keno game or a number of wagers placed on a simulated roulette game.

Those skilled in the art will readily appreciate that the creation of a robust class II gaming engine and the replication of class III game results using class II bingo math design to create successful class II games and class II gaming systems is an intellectually challenging and time consuming project. In fact, many casino game manufacturers may be delayed or entirely deterred from entering the class II market because of the complexities and the development time involved, and others have tried unsuccessfully or failed altogether because of such issues.

Embodiments of the present invention allow casino game manufacturers to enter the class II market in a short period of time with class II games that deliver the bingo math design accuracy required to produce the player experience and earning potential nearly identical to, or indistinguishable from, that of the original game design targets. The manufacturer's original game design targets may be selected from newly created games, existing class III games, class II games that need a better bingo math design to better match the targeted player experience/earning potential, or any type of game where a probability of winning a certain prize is defined for the player. The manufacturer may integrate the class II gaming engine into a new or existing game terminal to easily and readily deploy a new game design as, or convert an existing game design to, a class II game and accurately replicate the original game design targets.

Embodiments of the invention include a robust class II gaming engine that handles the many ways that games can be played. Multiple games and game terminals may be connected to one class II gaming engine. In addition, multiple games from multiple manufacturers may be connected to the same class II gaming engine.

Figure 3:
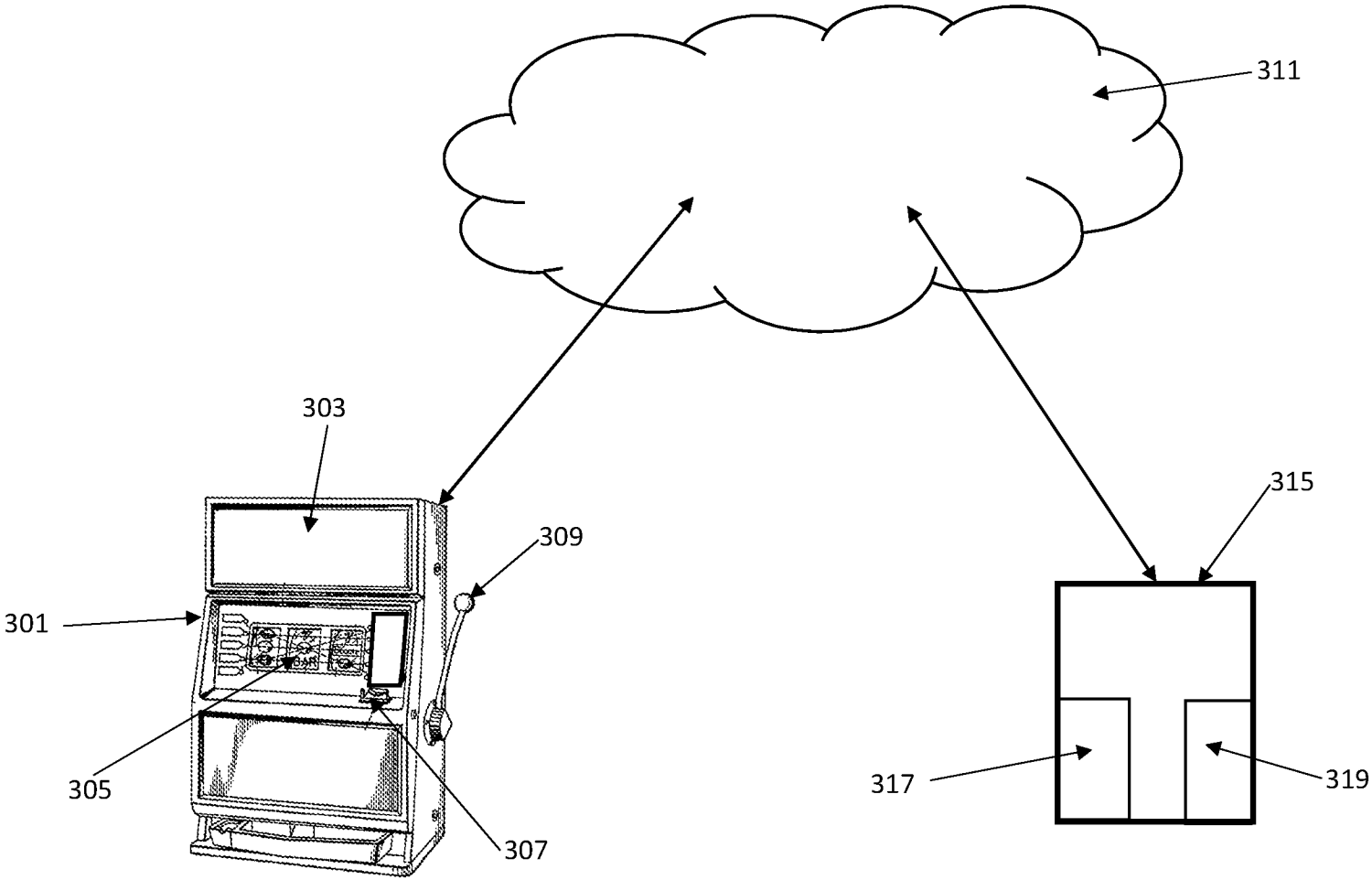
FIG. 3 is a schematic view of one embodiment of a class II gaming system of the present invention, including a game terminal communicatively connected through the cloud to a class II game engine.

Referring now to FIG. 3, the game terminal 301 may include a first display 303 for displaying the bingo game results, a second display 305 for displaying the associated feature resolution, or both may be included on a single display, and also may include a payment apparatus 307, and a user input apparatus 309 which, in some embodiments, is configured to accept payment of indicia of credit. The game terminal 301 is communicatively connected through the cloud 311 to a class II gaming engine 315 having a processor 317 and transient memory other non-transitory machine-readable medium 319. Game terminals 301 used to connect with the class II gaming engine are not limited to traditional computer-based slot machine cabinets or legacy operating systems. For example, the game terminals can be traditional computer-based slot machine cabinets, kiosks, mobile devices, smart phones, network/internet devices, etc. The operating systems can be Windows, Linux, IOS, Android, UNIX, BSD, a derivative of any one of these or other publicly available operating systems. The game terminals may utilize development languages such as Flash, Java, C++, C#, HTML5, and many others. In fact, any platform and language capable of utilizing networking and implementing arbitrary transport and messaging protocols (TCP/IP, TLS, HTTP/2, protobuf, and gRPC specifically in this embodiment) are candidates for connection with embodiments of the class II gaming engine of the present invention.

To convert a class III game to a class II game using embodiments of the present invention, a blueprint showing the architecture of the class III game is first created. The class III game is partitioned into each of its separate states and transitions, if any. The states and their identifying properties are defined in a data set used by the class II gaming engine. Statistics are collected throughout the game play cycle of the class III game, including the prizes and state transitions. The states and prize distributions are then appropriately restructured or repartitioned to begin construction of a class II game that will replicate the class III game.

Figure 4:
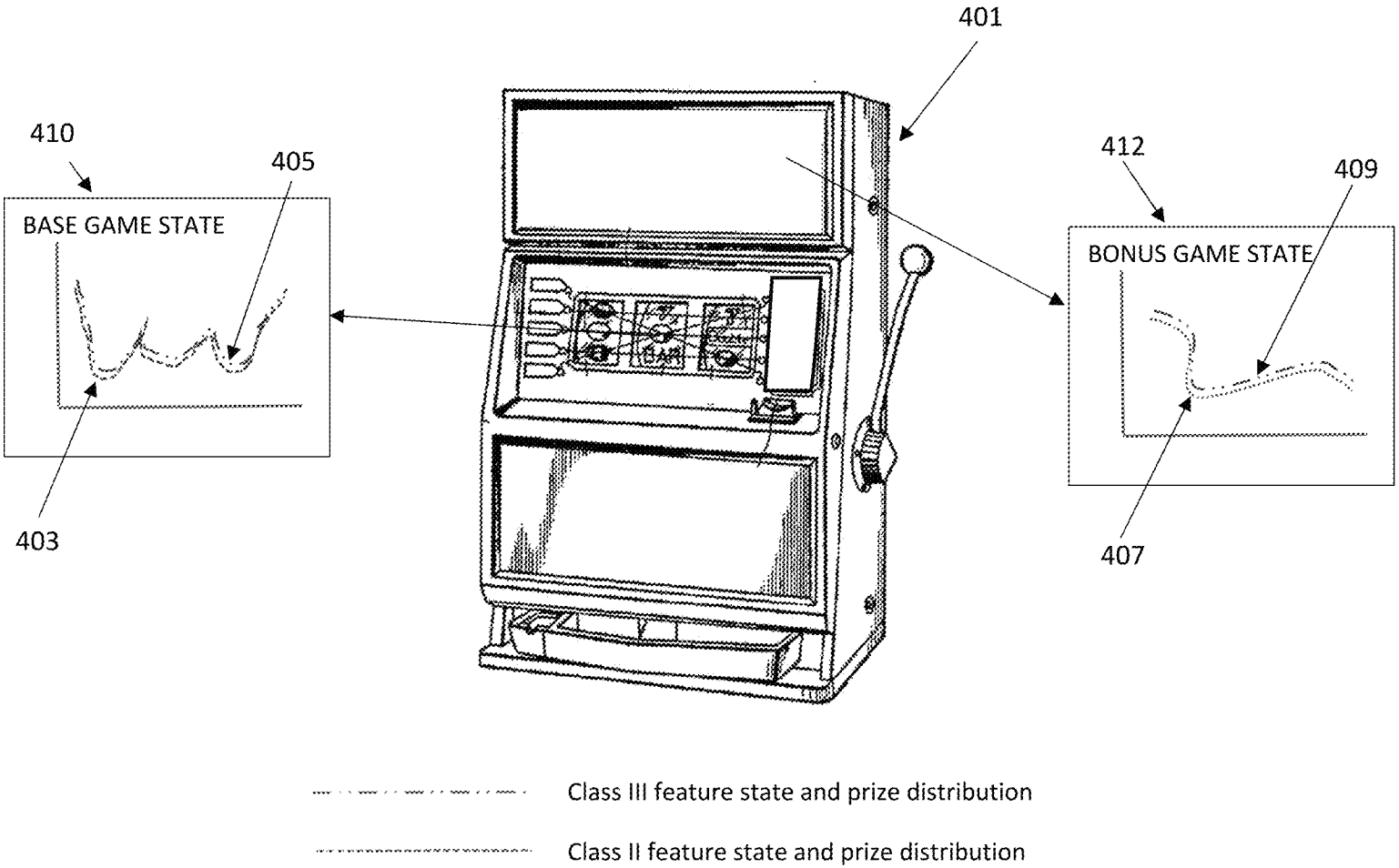
FIG. 4 is a schematic view of one embodiment of a class II gaming system of the present invention, including a depiction of how the state and prize distributions of a class II game replicate the state and prize distributions within a single feature of a class III game.

As shown in FIG. 4, the state and prize distributions 403 of the class II game replicates the state and prize distributions 405 within a single feature of a class III game and the Class III game is a slot machine 401. In some embodiments, the single feature may be in a base game state 410. In other embodiments, the state and prize distributions 407 of the class II game replicates the state and prize distributions 409 within a single feature of a class III game and the single feature may also, or alternatively, be in a bonus game state 412.

Those skilled in the art will appreciate that, in order to be class II-compliant, it is fundamental that the results generated by the class II gaming engine be derived from a bingo event. For example, if the odds of a particular prize or state transition occurring in the class III game are P, a bingo event having a probability of P would be used by the class II gaming engine to determine the occurrence of that prize or state transition. Subsets of the universe of bingo patterns are selected as a working basis for a search algorithm. Replicating a class III game, its rules, states, transitions, and credit win probabilities using bingo patterns and a class II gaming engine is a non-trivial task.

The class III game prizes and distribution statistics are paired against matching distributions of pattern set solutions to a bingo game. Feature nesting is utilized to increase the number of available patterns used by the class II gaming engine to determine the bingo-generated game results for a targeted prize distribution within a single feature. Upon finding a solution that adequately replicates the class III game state using a bingo-game distribution, a bingo prize table with the targeted credit wins and transitions for the class II game state, and its representative pattern sets, is generated. In some embodiments, certain non-standard transitions (e.g., player-choice between different types of bonus game states to play next) might be identified within an auxiliary table. Visual layouts corresponding to the resultant prizes of a class III game state are also compiled to create a visual map data set for providing visual aid results to the game terminal (e.g., the reel stops of a slot machine game state or outcome displays of a bonus game state). Once the game is designed, the data is summarized and placed in storage to be used by the game engine. The game engine plays bingo games for all the participating players using the rules and patterns from the design.

The class II gaming engine processes requests to participate in a bingo game from players made at game terminals. Based on the game selected by the player, pattern sets are defined in the class II gaming engine. Upon successfully joining a new or open bingo game, a player is issued a card by the class II gaming engine that is evaluated for any ending pattern or secondary pattern prizes, as defined for the specific class II game state played by the player. The class II gaming engine may instruct the game terminal, based on the bingo game results, to resolve the feature associated with bingo card and class II game state played, or results may cause nested bingo cards to be played against their respective defined class II game states by the class II gaming engine until the feature is resolved, as defined by the prizes in the pattern sets for the nested cards played. The class II gaming engine instructs the game terminal to display the nested bingo cards, their respective bingo game play results, and the associated feature resolution of the game.

In one exemplary embodiment, a class III game is required to be converted into a class II game for operation in a casino. The class III game has a slot reel using 15 lines as the base game state and a pick 'em bonus game state with 16 possible prize results. The statistical results for the class III game features are collected and it is determined that the base game state has 1,000 different prize amounts that may be awarded across all possible game play results of such state. Using bingo patterns to create the probabilities for each prize amount, the number of prize amounts that may typically be handled on a single bingo card evaluation is in the range of 200 to 250. Using a single bingo card to resolve the targeted prize distribution of the feature would, therefore, require truncating three-fourths of the prize amounts, thus changing the play and the feel of the targeted game design.

Using feature nesting, the initial bingo card played would have 5 prizes that could be won. Each of these prizes would be a win of an additional bingo card. Each nested bingo card would have 200 prize amounts that could be won. This allows for 1,000 different prize levels to be won and used to resolve the feature. At least one of the patterns on one of the nested bingo cards could win the bonus game feature.

Therefore, the final outcomes for the player in the base game feature are (A) there is no winner on the first bingo card played, or (B) a nested card is won on the first card played, and when the nested card is played, the possible outcomes for the player are: (1) there is no winner on the nested bingo card, (2) there is a credit win on the nested card, (3) there is a bonus game feature win on the nested card, or (4) there is a credit win and a bonus game feature win on the nested card. Furthermore, if there is a bonus game feature win as a result of the first bingo card or any nested card played, then the class II gaming engine instructs the game terminal to transition to the bonus game feature and display the pick 'em bonus game to the player. Since the pick 'em bonus game state only has 20 possible prize outcomes, this feature is resolved by the results of one card played.

The class II game terminal may include a first display for displaying the bingo game results, a second display for displaying an associated feature resolution, a class II gaming engine for processing bingo game play requests, results, and other relevant data, a payment apparatus for accepting payment or indicia of credit, at least one user input apparatus, and a network interface connecting the first display, the second display, the class II gaming engine, the payment apparatus, and the user input apparatus to a network, such as the internet. In some embodiments, a single display may display both the bingo game results and the associated feature resolution. During each bingo game, essential information is sent from the game engine to the game terminal such that the bingo game and the simulated slot game can be displayed.

The game terminal also includes at least one computer processor configured to acknowledge receipt of payment or an indicia of credit to initiate a game from the payment apparatus, receive instructions from the user input apparatus to play a class II game, instruct the first display to display one or more nested bingo cards, instruct the second display to display the feature resolution through instructions processed through the network interface from the class II gaming engine, determine a secondary pattern or ending pattern of the bingo game, display the a secondary pattern or ending pattern on the first display, use the a secondary pattern or ending pattern to process the result of the class III game, and display the result of the features on the second display.

Yet other implementations of the invention provide a computer program embodied on tangible memory or on other non-transitory, machine-readable medium. The terms "tangible" and "non-transitory," as used herein, are intended to describe a computer-readable storage medium (or "memory") excluding propagating electromagnetic signals, but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including for example, random access memory (RAM). Program instructions and data stored on a tangible computer-accessible storage medium in non-transitory form may further be transmitted by transmission media or signals such as electrical, electromagnetic, or digital signals, which may be conveyed via a communication medium such as a network and/or a wireless link.

While the present system has been disclosed according to the preferred embodiment of the invention, those of ordinary skill in the art will understand that other embodiments have also been enabled. Although specific advantages have been enumerated above, various embodiments may include some, none, or all of the enumerated advantages. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connect, connected, connecting" or "integrate" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of class III games, class II games, and class II gaming systems known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

To aid the Patent Office and any readers of any patent issued on this application in interpreting the claims appended hereto, the applicant wishes to note that it does not intend any of the appended claims or claim elements to invoke 35 U.S.C. 112(f) unless the words "means for" or "step for" are explicitly used in the particular claim.

What is claimed is:

1. A game terminal, comprising:

a class II gaming engine communicatively connected to a game terminal, the class II gaming engine configured to (i) receive a game play request from a player and issue a card to determine prizes for a first class II game state, wherein (A) the prizes for the first class II game state are derived from occurrence of secondary patterns on the card played in a bingo game and (B) the first class II game state having a first pattern set associated with a single game feature defined by the game play request; and then (ii) process play requests for the first class II game state; and if the single game feature is resolved, instruct the game terminal to display resolution of the single game feature associated with the first class II game state; and if the single game feature is not resolved, issue an additional card as a prize for the first class II game state to determine prizes for a second class II game state, (A) the prizes for the second class II game state are derived from occurrence of secondary patterns on the additional card, and (B) the second class II game state having a second pattern set associated with the single game feature, and then process play requests for the second class II game state; and if the single game feature is resolved, instruct the game terminal to display resolution of the single game feature associated with the first class II game state and the second class II game state.

2. The game terminal of claim 1, wherein the prizes replicate the prizes within the single game feature of a class III game.

3. The game terminal of claim 1, wherein the prizes replicate the prizes within the single game feature of a class III game, and the Class III game is a slot machine.

4. The game terminal of claim 1, wherein the prizes replicate the prizes within the single game feature of a class III game, and the game terminal is located in a casino.

5. The game terminal of claim 1, wherein the prizes replicate the prizes within the single game feature of an existing class III game.

6. The game terminal of claim 1, wherein the single game feature is a base game state.

7. The game terminal of claim 1, wherein the single game feature is a bonus game state.

8. The game terminal of claim 1, wherein an outcome of the additional card is a second card, thereby further increasing the number of available pattern sets that may be used by the class II gaming engine to determine the prizes within a resolution of the single game feature.

9. The game terminal of claim 1, further having a display on which the card is displayed.

10. The game terminal of claim 1, further having a display on which the additional card is displayed.

11. The game terminal of claim 1, further having a display on which the resolution of the single game feature is displayed.

12. A game terminal comprising:

a display, a payment apparatus, a user input apparatus, and a class II gaming engine communicatively connected to the display, the payment apparatus and the user input apparatus, the class II gaming engine being configured to receive a game play request from a player and issue a card to determine prizes for a first class II game state, the prizes for the first class II game state are derived from occurrence of secondary patterns on the card played in a bingo game and the first class II game state having a first pattern set associated with a single game feature defined by the game play request, and then process play requests for the first class II game state; and if the single game feature is resolved, instruct the game terminal to display resolution of the single game feature associated with the first class II game state; and if the single game feature is not resolved, issue an additional card as a prize in the first class II game state to determine prizes for a second class II game state, the prizes for the second class II game state are derived from occurrence of secondary patterns on the additional card played in a bingo game and the second class II game state having a second pattern set associated with the single game feature, and then process play requests for the second class II game state; and if the single game feature is resolved, instruct the game terminal to display resolution of the single game feature associated with the first class II game state and the second class II game state.

13. The game terminal of claim 12, wherein the prizes replicate the prizes within the single game feature of a class III game.

14. The game terminal of claim 12, wherein the prizes replicate the prizes within the single game feature of a class III game, and the Class III game is a slot machine.

15. The game terminal of claim 12, wherein the prizes replicate the prizes within the single game feature of a class III game, and the game terminal is located in a casino.

16. The game terminal of claim 12, wherein the prizes replicate the prizes within the single game feature of an existing class III game.

17. The game terminal of claim 12, wherein the single game feature is a base game state.

18. The game terminal of claim 12, wherein the single game feature is a bonus game state.

19. The game terminal of claim 12, wherein an outcome of the card is a second additional card, thereby further increasing the number of available pattern sets that may be used by the class II gaming engine to determine the prizes within a resolution of the single game feature.

20. The game terminal of claim 12, wherein the card is displayed on the display.

21. The game terminal of claim 12, wherein the additional card is displayed on the display.

22. The game terminal of claim 12, wherein a resolution of the single game feature is displayed on the display.

23. The game terminal of claim 12, wherein the payment apparatus is configured to accept payment or indicia of credit.

* * * * *